US006590551B1

(12) United States Patent
Kim

(10) Patent No.: US 6,590,551 B1
(45) Date of Patent: Jul. 8, 2003

(54) APPARATUS AND METHOD FOR DRIVING SCANNING LINES OF LIQUID CRYSTAL PANEL WITH FLICKER REDUCTION FUNCTION

(75) Inventor: Jeom Jae Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/186,338

(22) Filed: Nov. 5, 1998

(30) Foreign Application Priority Data

Nov. 20, 1997 (KR) ..... 97-61467

(51) Int. Cl.[7] ..... G09G 3/36

(52) U.S. Cl. ..... 345/92; 345/87; 345/100; 349/151

(58) Field of Search ..... 345/90, 98, 100, 345/92, 94, 95, 93, 101, 102, 205, 206, 208, 87, 99, 204, 214; 349/151

(56) References Cited

U.S. PATENT DOCUMENTS 4,775,861 A * 10/1988 Saito ..... 345/93
4,930,875 A * 6/1990 Inou et al. ..... 350/333
5,164,851 A * 11/1992 Kanemori et al. ..... 349/55
5,694,145 A * 12/1997 Kondo et al. ..... 345/90
5,801,674 A * 9/1998 Shimizu ..... 345/98
6,014,190 A * 1/2000 Kim et al. ..... 349/39
6,019,796 A * 2/2000 Mei et al. ..... 938/151
6,100,865 A * 8/2000 Sasaki ..... 345/92

FOREIGN PATENT DOCUMENTS

JP 7199154 8/1995

* cited by examiner

*Primary Examiner*—Bipin Shalwala
*Assistant Examiner*—Mansour M. Said
(74) *Attorney, Agent, or Firm*—Birch, Stewart, Kolasch & Birch, LLP

(57) ABSTRACT

An apparatus and method for driving scanning lines of a liquid crystal panel for reducing generation of flickers appearing on the image displayed by the liquid panel due to misalignments in the liquid crystal panel. The apparatus includes a driving unit for selectively generating a first scan signal or a second scan signal based on control signals to drive the plurality of scanning lines, where one of the control signals indicates whether or not at least one of the TFTs of the liquid crystal panel is misaligned. The driving unit can includes a driving IC chip, or a driving IC chip and a switch.

34 Claims, 3 Drawing Sheets

APPARATUS AND METHOD FOR DRIVING SCANNING LINES OF LIQUID CRYSTAL PANEL WITH FLICKER REDUCTION FUNCTION

BACKGROUND OF THE INVENTION

1. Field of the Invention

This invention relates to an apparatus and method for driving a liquid crystal display (LCD) and, more particularly, to an apparatus and method for driving scanning lines formed in the LCD panel.

2. Description of Background Art

Generally, a conventional LCD apparatus controls the light transmissivity of liquid crystal in the liquid crystal panel based on the voltage level of video signals applied to the liquid crystal panel to display images. The liquid crystal panel includes liquid crystal cells arranged in a matrix pattern, and control switches for selectively applying the video signals to each liquid crystal cell. The control switches are formed with thin film transistors (TFTs) with their sources and drains formed in an alternating pattern. Often during the fabrication process of the liquid crystal panel, the TFTs are misaligned, causing them to have different parasitic capacitances. The differences in the parasitic capacitance between the TFTs distort tile video signals applied to tile liquid crystal cells, causing undesirable flickers in the picture being displayed by the liquid crystal panel.

FIG. 1A shows a schematic view of such a conventional liquid crystal panel having a delta structure. As shown therein, the conventional liquid crystal panel includes a plurality of odd-numbered scanning lines 4', a plurality of even-numbered scanning lines 4" formed between the odd-numbered scanning lines 4', and a plurality of data lines 2 crossing the scanning lines 4' and 4". Each of the odd-numbered scanning lines 4' is connected to a plurality of first TFTs (odd-numbered TFTs) 8A arranged in a row, and each of the even-numbered scanning lines 4" is connected to a plurality of second TFTs (even-numbered TFTs) 8B arranged in another row. Each of the TFTs 8A and 8B is connected to a liquid crystal cell (or pixel electrode 6). Each of the first TFTs 8A is turned on and off based on a scanning pulse applied through the corresponding scanning line 4' connected to the first TFTs 8A. Each of the second TFTs 8B is turned on and off based on a scanning pulse applied through the corresponding scanning line 4" connected to the second TFT 8B.

By turning on the first TFT 8A, a current path between the corresponding data line 2 connected to the TFT 8A and the corresponding liquid crystal cell 6 is established, and by turning on the second TFT 8B, a current path between the corresponding data line 2 connected to the TFT 8B and the corresponding liquid crystal cell 6 is established. Through the established current paths, data signals from the data lines 2 are applied to the corresponding TFTs 8A and 8B. The sources and drains of the first or second TFTs 8A or 8B are simultaneously formed using a same fabrication process, and their formation positions can vary with respect to the corresponding gate.

FIG. 1B shows an enlarged view of portion 1B shown in FIG. 1A. As shown in FIG. 1B, an active region AR partially overlaps the source ST, the drain DT and the gate GT of each TFT 8A or 8B to establish first and second parasitic capacitors Cgs and Cgd. The first parasitic capacitor Cgs emerges between the gate GT and the source ST while the second parasitic capacitor Cgd emerges between the gate GT and the drain DT of the TFT 8A or 8B. The characteristic of the parasitic capacitors Cgs and Cgd can differ substantially from each other depending on the exact positions of the source ST and the drain DT moved. For example, the parasitic values of the capacitors Cgs and Cgd differ from each depending on the position of the TFTs and the exact position of the source ST and the drain DT. For instance, if all the sources ST and the drains DT of the TFTs 8A and 8B are misaligned to the right from the original or predetermined position when they are formed, the first parasitic capacitor Cgs of the odd-numbered TFTs 8A has a larger capacitance value than the first parasitic capacitor Cgs of the even-numbered TFTs 8B, while the second parasitic capacitor Cgd of the odd-numbered TFTs 8A has a smaller capacitance value than the second parasitic capacitor Cgd of the even-numbered TFTs 8B. On the contrary, if the sources ST and the drains DT are misaligned to the left from the desired position, the first parasitic capacitor Cgs of the odd-numbered TFTs 8A has a smaller capacitance value than the first parasitic capacitor Cgs of the even-numbered TFTs 8B, while the second parasitic capacitor Cgd of the odd-numbered TFTs 8A has a larger capacitance value than the second parasitic capacitor Cgd of the even-numbered TFTs 8B.

The second parasitic capacitors Cgd do not directly influence the liquid crystal cells 6; however, the first parasitic capacitors Cgs vary the voltage level of video signals applied to the liquid crystal cells 6. This occurs because, as shown in FIG. 2A, the first parasitic capacitor Cgs is serially connected to a parallel circuit 6*a* of the corresponding liquid crystal cell 6 having a support capacitor Cst. The serial connection of the first parasitic capacitor Cgs lowers the voltage level of the corresponding liquid crystal cell 6 at the time the corresponding TFT is turned off.

Specifically, as shown in FIG. 2B, the TFT (8A or 8B) is turned on when a high level voltage (Vgh) of the scan signal SS is applied to the TFT through the corresponding scanning line 4. As the TFT is turned on, a video signal VD on the corresponding data line 2 is applied to the corresponding liquid crystal cell 6 and the support capacitor Cst. At this time, the voltage Vd of the video signal VD is charged into the liquid crystal cell 6 and the support capacitor Cst, and the voltage difference between the high level voltage Vgh and the video signal voltage Vd is charged to the first parasitic capacitor Cgs. When the scan signal SS transits from the high level voltage Vgh to a low level voltage Vgl, the TFT 8 is turned off to disconnect the current path from the data line 2 to the liquid crystal cell 6 and the support capacitor Cst. Then the first parasitic capacitor Cgs suddenly discharges the charged voltage into the corresponding scanning line 4 and, simultaneously, is charged by the voltage from the liquid crystal cell 6 and the support capacitor Cst. As a result, the voltage charged in the liquid crystal cell 6 is instantaneously reduced. By such a charge and discharge operation of the parasitic capacitor Cgs, an output signal CLS of the liquid crystal cell 6 sharply decreased by a predetermined voltage ΔVp from the video signal voltage Vd as shown in FIG. 2B. The drop voltage ΔVp in the output signal CLS of the liquid crystal cell 6 can be expressed as follows:

$$\Delta Vp2 = \frac{(Cgs)(Vg)}{Clc + Cst + Cgs} \tag{1}$$

wherein Vg represents a voltage difference between the high level voltage Vgh and the low level voltage Vgl of the scan signal SS, and Clc represents a capacitance value of the corresponding liquid crystal cell 6. Since the drop voltage ΔVp changes in accordance with the capacitance value of the parasitic capacitor Cgs as seen from the above equation (1), the drop voltage ΔVp in the output of the liquid crystal cell 6 connected to odd-numbered TFT 8A and the drop voltage ΔVp in the output of the liquid crystal cell 6 connected to even-numbered TFT 8B differ from each other when misalignment occurs during the fabrication of the TFTs 8A and 8B.

For example, if the overlapped width of the source ST and the active region AR is set to be 3 μm, but the position of the source ST formed on the substrate is shifted to the left by 1 μm due to misalignment, the source ST and the active region AR of each odd-numbered TFT 8A are overlapped by 2 μm while the source ST and the active region AR of each even-numbered TFT 8B are overlapped by 4 μm. If the video signal VD has an intermediate gray level voltage, then the drop voltage ΔVp in the output signal of tile liquid crystal cell 6 connected to the odd-numbered TFT 8A becomes 192 mV, while the drop voltage ΔVp for the liquid crystal cell 6 connected to the even-numbered TFT 8B becomes 380 mV. Although the odd-numbered line liquid crystal cells and the even-numbered line liquid crystal cells respond to the same video signals, the outputs thereof differ from each other.

As described above, in the delta structure of a conventional liquid crystal panel, the parasitic capacitance of the odd-numbered TFTs can differ substantially from that of the even-numbered TFTs due to misalignment occurring during the fabrication process. This causes the voltage variation ratio of the odd-numbered line liquid crystal cells to be different from that of the even-numbered liquid crystal cells, which causes flickers to be appear in the pictures displayed by the same liquid crystal panel.

SUMMARY OF THE INVENTION

Accordingly, it is an object of the present invention to provide an apparatus and method for driving scanning lines of a liquid crystal panel, which prevent generation of flickers appearing due to misalignment of TFTs.

In order to achieve this and other objects of the invention, an apparatus for driving scanning lines of a liquid crystal panel having TFTs according to the present invention includes a driving unit for selectively generating a first scan signal or a second scan signal based on control signals to drive the plurality of scanning lines, one of the control signals indicating whether or not at least one of the TFTs is misaligned.

In a liquid crystal display device including a liquid crystal panel having thin film transistors (TFTs) and a plurality of scanning lines connected to the TFTs, a method for driving the plurality of scanning lines according to the present invention includes the steps of selectively generating a first scan signal or a second scan signal based on control signals, one of the control signals indicating whether or not at least one of the TFTs is misaligned; and applying the generated first or second scan signal to the liquid crystal panel to drive the plurality of scanning lines.

These and other objects of the present application will become more readily apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed descriptions.

BRIEF DESCRIPTION OF THE DRAWINGS

These and other objects of the invention will be apparent from the following detailed description of the embodiments of the present invention with reference to the accompanying drawings, in which.

DETAILED DESCRIPTION OF THE PREFERRED EMBODIMENTS

Figure 1A:
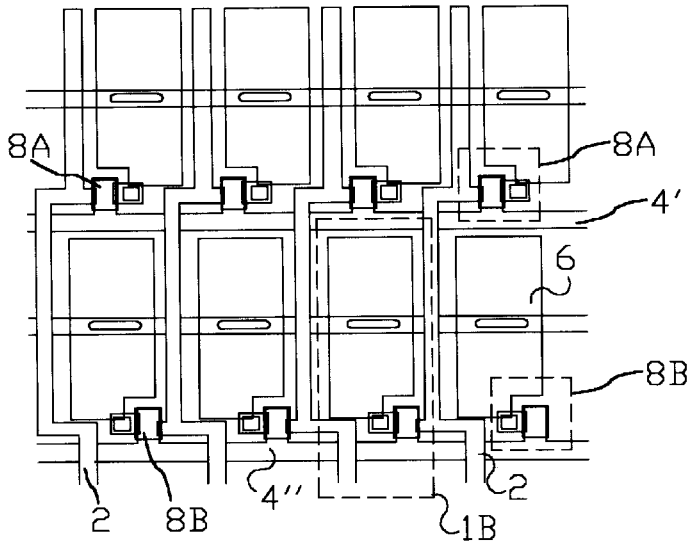
FIG.1A PRIOR ART
FIG. 1A is a layout of a conventional liquid crystal panel.
Figure 1B:
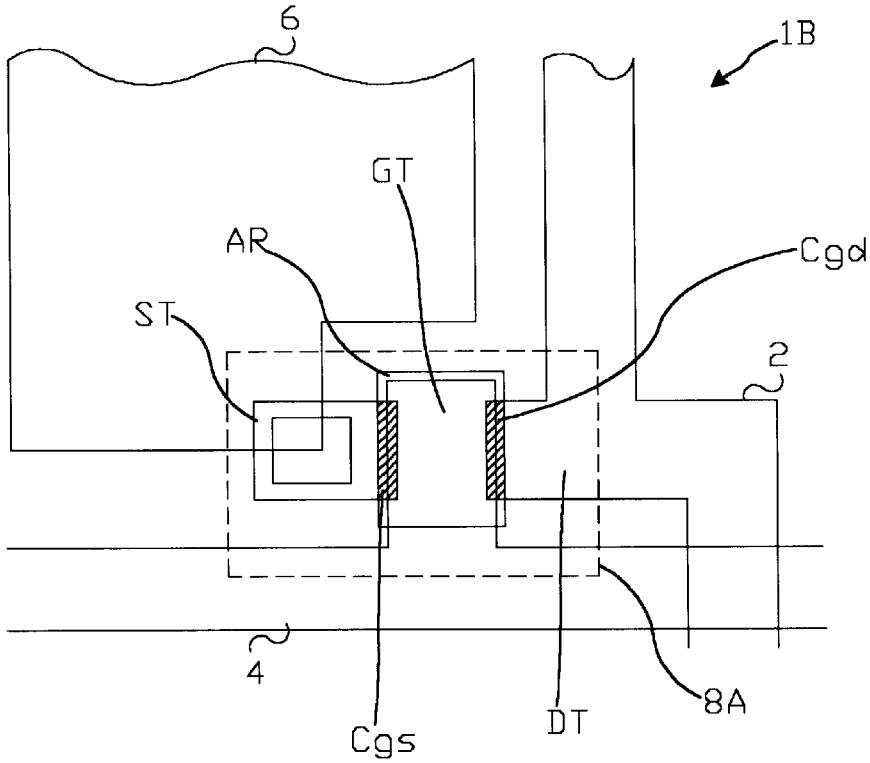
FIG.1B PRIOR ART
FIG. 1B is a detailed view of portion 1B in FIG. 1A.
Figure 2A:
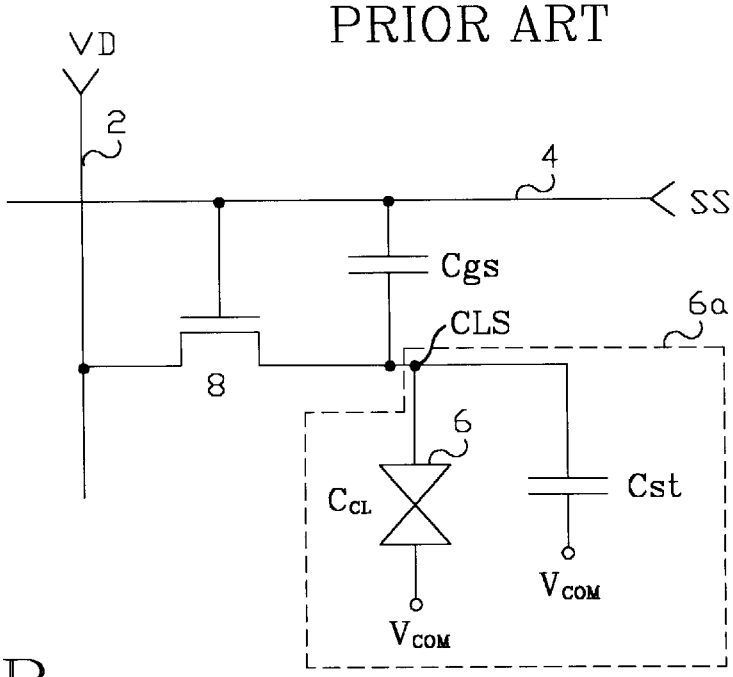
FIG.2A PRIOR ART
FIG. 2A is an electrical equivalent circuit diagram of FIG. 1B.
Figure 2B:
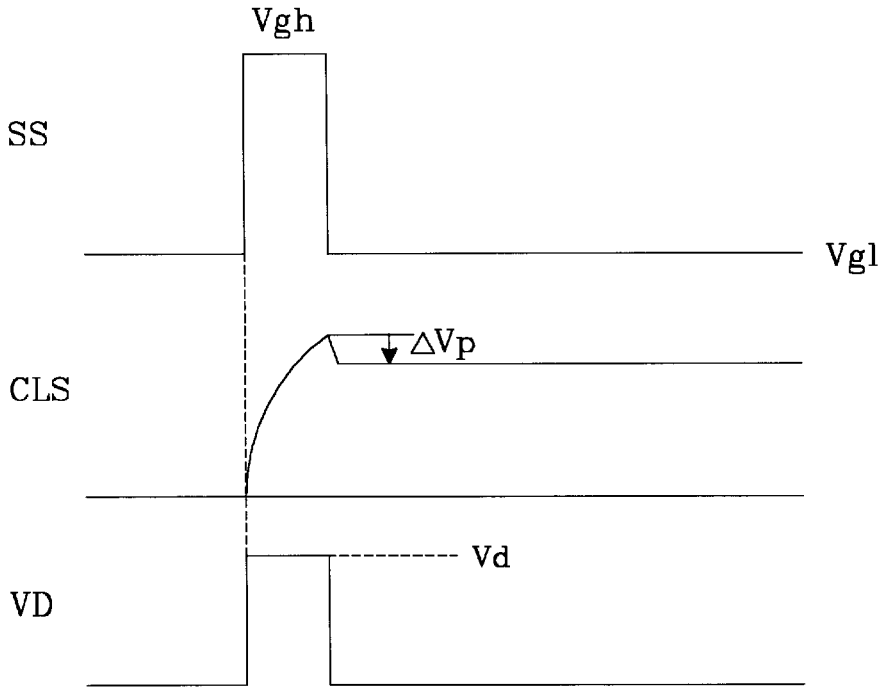
FIG.2B PRIOR ART
FIG. 2B is an operational waveform diagram for the elements shown in FIG. 2A.
Figure 3:
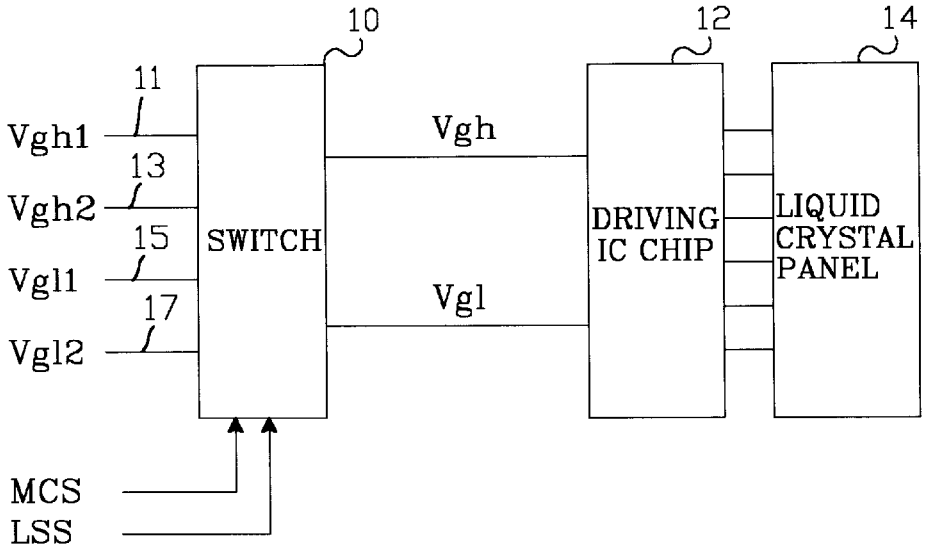
FIG. 3 is a schematic diagram showing a configuration of an apparatus for driving scanning lines of a liquid crystal panel according to an embodiment of the present invention.

Referring to FIG. 3, there is shown an apparatus for driving scanning lines of a liquid crystal panel according to an embodiment of the present invention. As shown therein, the apparatus of the present invention includes a switch 10 for receiving voltage signals from first to fourth input lines 11, 13, 15 and 17, respectively; and a driving integrated circuit (IC) chip 12 connected between the switch 10 and a liquid crystal panel 14. Scan signals SS (e.g., as shown in FIG. 2B) applied to the scanning lines of the liquid crystal panel 14 can be composed of a different combination of signals Vgh1, Vgh2, Vgl1 and Vgl2. The high level of the scan signal SS can correspond to the high level voltage signal Vgh1 or Vgh2, and the low level of the scan signal SS can correspond to the low level voltage signal Vgl1 or Vgl2. The liquid crystal panel 14 can be the conventional liquid crystal panel as shown in FIG. 1A or other liquid crystal panels known in the art.

The first to fourth input lines 11 to 17 are connected to a power supply (not shown). The first high level voltage signal Vgh1 is applied to the first input line 11, where the voltage level of the second high signal Vgh2 is higher than that of the first high signal Vgh1. The first low level voltage signal Vgl1 is applied to the third input line 15, where the voltage level of the second low signal Vgl2 is lower than that of the first low signal Vgl1.

The switch 10 transfers one of the voltage signals Vgh1, Vgh2, Vgl1 and Vgl12 to the driving IC chip 12. If the TFTs of the liquid crystal panel 14 are not misaligned during the fabrication process, the switch 10 stably delivers any one of the first and second high level voltage signals Vgh1 and Vgh2 to the driving IC chip 12 as the high level scan signal SS. However, if the TFTs of the liquid crystal panel 14 are formed as misaligned during the fabrication process, the switch 10 alternatingly applies the first and second high level voltage signals Vgh1 and Vgh2 to the driving IC chip 12 as the odd-numbered and even-numbered scanning lines of the panel 14 are driven sequentially. For example, the switch 10 applies the first high level voltage signal Vgh1 to the driving IC chip 12 as the high level scan signal SS when the odd-numbered scanning lines of the liquid crystal panel 14 are driven, and applies the second high level voltage signal Vgh2 to the driving IC chip 12 as the high level scan signal SS when the even-numbered scanning lines of the liquid crystal panel 14 are driven.

To generate a low level scan signal SS, the switch 10 transfers any one of the first and second low level voltage signals Vgl1 and Vgl2 to the driving IC chip 12. If the TFTs of the liquid crystal panel 14 are not misaligned during the fabrication process, the switch 10 stably delivers any one of the first and second low level voltage signals Vgl1 and Vgl2 to the driving IC clip 12. However, if the TFTs are misaligned, the switch 10 alternatingly applies tile first and second low level voltage signals Vgl1 and Vgl2 to the driving IC chip 12 as the even-numbered and odd-numbered scanning lines are sequentially driven. For example, the switch 10 applies the first low level voltage signal Vgl1 to the driving IC chip 12 as the low level scan signal SS when the odd-numbered scanning lines of the liquid crystal panel 14 are driven, and applies the second low level voltage signal Vgl2 to the driving IC chip 12 as the low level scan signal SS when the even-numbered scanning lines of the liquid crystal panel 14 are driven.

In order to perform the above-described switching operation by the switch 10, a mode signal MCS and a line switching signal LSS are applied to the switch 10 from an external source. The mode signal MCS indicates whether or not the TFTs of the liquid crystal panel 14 are misalignment, and the line switching signal LSS indicates whether the odd-numbered or even-numbered scanning lines are driven. The switch 10 includes two control switches commonly responding to the mode signal MCS and the line switching signal LSS.

In another example of the present invention, the switch 10 receives only one low level voltage signal rather than both the first and second low level voltage signals Vgl1 and Vgl2, and transfers the one low level voltage signal to the driving IC chip 12 at all times as the low level scanning signal SS. In this case, the switch 10 employs a single control switch for carrying out the switching just between the high level voltage signals Vgh1 and Vgh2.

In still another example of the present invention, the switch 10 receives only one high level voltage signal rather than both the first and second high level voltage signals Vgh1 and Vgh2, and transfers the one high level voltage signal to the driving IC chip 12 at all times as the high level scanning signal SS. In this case, the switch 10 employs a single control switch just for switching between the low level voltage signals Vgl1 and Vgl2.

As described above, the driving IC chip 12 applies a pulse shaped scan signal SS to the scanning lines of the liquid crystal panel 14 to drive the even-numbered and odd-numbered scanning lines. The pulse shaped scan signal SS is composed of the high level voltage signal Vgh1 or Vgh2 and the low level voltage signal Vgl1 or Vgl2 output from the switch 10. The scan signal SS has a constant swing width depending upon whether or not the TFTs of the liquid crystal panel 14 are misaligned, or has a different swing width depending on the scanning lines. In other words, when the TFTs of the liquid crystal panel 14 are not misaligned according to the mode signal MCS, the scan signal SS composed of the first or second low voltage Vgl1 or Vgl2, and the first or second high voltage Vgh1 or Vgh2 is applied to the liquid crystal panel 4. If the TFTs are misaligned according to the mode signal MCS, a swing width of the scan signal SS applied to the odd-numbered scanning lines differs from that of the scan signal SS applied to the even-numbered scanning lines of the liquid crystal panel 4.

For example, if the pulsed-shaped scan signal SS for driving the odd-numbered scanning lines of the liquid crystal panel 14 is composed of the first low level voltage signal Vgl1 and the first high level voltage signal Vgh1, then the scan signal SS for driving the even-numbered scanning lines is composed of the second low level voltage signal Vgl2 and the second high level voltage signal Vgh2. On the other hand, if the scan signal SS for driving the odd-numbered scanning lines is composed of the second low level voltage signal Vgl2 and the second high level voltage signal Vgh2, then the scan signal SS for driving the even-numbered scanning lines is composed of the first low level voltage signal Vgl1 and the first high voltage signal Vgh1.

As described above, a swing width of the odd-numbered scan signal differs from that of the even-numbered scan signal when the TFTs of the liquid crystal panel 14 are misaligned, so that the liquid crystal cells corresponding to the odd-numbered scanning lines have the same voltage variation ratio as the liquid crystal cells corresponding to the even-numbered scanning lines. This prevents flickers from appearing in the images displayed by the liquid crystal panel 14.

Figure 4:
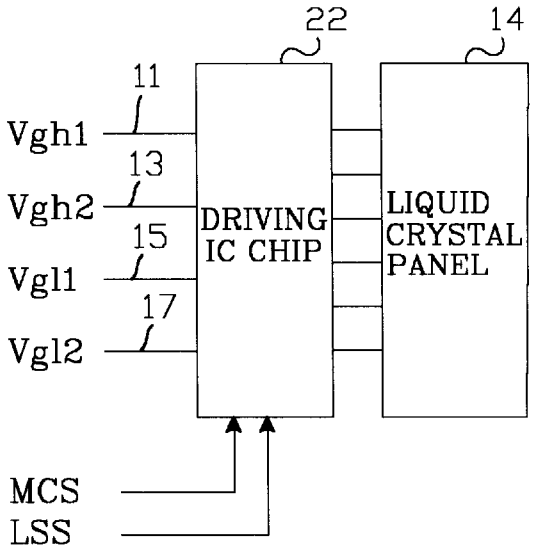
FIG. 4 is a schematic diagram showing a configuration of an apparatus for driving scanning lines of a liquid crystal panel according to another embodiment of the present invention.

Referring now to FIG. 4, there is shown an apparatus for driving scanning lines of a liquid crystal panel according to another embodiment of the present invention. In this embodiment, the switch 10 is incorporated into the driving IC chip 22 such that the driving IC chip 22 selects the different voltage signals Vgh1–Vgl2 to generate a scan signal SS for driving the even and odd-numbered scanning lines of the liquid crystal panel 14.

As shown therein, the scanning line driving apparatus includes a driving integrated circuit (IC) chip 22 connected to the first to fourth input lines 11, 13, 15 and 17, and the liquid crystal panel 14 coupled to the driving IC chip 22. The first to fourth input lines 11 to 17 are connected to a lower supply (not shown), and receive the voltage signals Vgh1, Vgh2, Vgl1 and Vgl2, respectively. The voltage level of the second high signal Vgh2 is higher than that of the first high signal Vgh1, and the voltage level of the second low signal Vgl2 is lower than that of the first low signal Vgl1.

The driving IC chip 22 switches between the high and low level voltages Vgh1, Vgh2, Vgl1, and Vgl2 as the switch 10 of the first embodiment. The mode signal MCS and the line switching signal LSS are applied to the driving IC chip 22 as discussed above in connection with the first embodiment.

In another example of the present invention, the driving IC chip 22 receives only one low level voltage signal rather than both the first and second low level voltage signals Vgl1 and Vgl2, and transfers the one low level voltage signal to the liquid crystal panel 14 at all times as the low level scanning signal SS. In this case, the chip 22 employs a single control switch for carrying out the switching just between the high level voltage signals Vgh1 and Vgh2.

In still another example of the present invention, the driving IC chip 22 receives only one high level voltage signal rather than both the first and second high level voltage signals Vgh1 and Vgh2, and transfers the one high level voltage signal to the liquid crystal panel 14 at all times as the high level scanning signal SS. In this case, the chip 14 employs a single control switch just for switching between the low level voltage signals Vgl1 and Vgl2.

Accordingly, the apparatus and method for driving the scanning lines of a liquid crystal panel according to the present invention provides a scan signal with varying swing width in accordance with the scanning lines of the liquid crystal panel when the TFTs of the liquid crystal panel are misaligned. This provides a uniform voltage variation ratio for each of the liquid crystal cells, and as a result, flickers do not appear on images displayed by the liquid crystal panel and the quality of the liquid crystal panel is improved.

Although the present invention has been explained by the embodiments shown in the drawings described above, it should be understood to an ordinary skilled person in the art that the invention is not limited to the embodiments, but rather that various changes or modifications thereof are possible without departing from the spirit of the invention.

What is claimed is:

1. In a liquid crystal display device including a liquid crystal panel having thin film transistors (TFTs) and a plurality of scanning lines connected to the TFTs, an apparatus for driving the plurality of scanning lines, comprising:

a driving unit for selectively generating a first scan signal based on control signals to drive the plurality of scanning lines, one of the control signals being generated When at least one of the TFTs is misaligned, said driving unit applying a second scan signal having the same voltage variation ratio as the first scan signal, so as to reduce flickers in images to be displayed.

2. The apparatus as claimed in claim 1, wherein the driving unit includes:

a switch for receiving first and second high level voltage signals, and first and second low level voltage signals, and selectively outputting one of the first and second high level voltage signals and one of the first and second low level voltage signals based on the control signals.

3. The apparatus as claimed in claim 2, wherein the driving unit further includes:

an integrated circuit (IC) chip, connected to the switch, for forming the first or second scan signal based on outputs of the switch, and applying the formed first or second scan signal to the liquid crystal panel.

4. The apparatus as claimed in claim 2, further comprising:

a first high voltage source for generating the first high level voltage signal; and a second high voltage source for generating the second high level voltage signal.

5. The apparatus as claimed in claim 2, further comprising:

a first low voltage source for generating the first low level voltage signal; and a second low voltage source for generating the second low level voltage signal.

6. The apparatus as claimed in claim 2, wherein the first or second scan signal is composed of a different combination of the first and second high level voltage signals and the first and second low level voltage signals.

7. The apparatus as claimed in claim 1, wherein the driving unit includes:

a switch for receiving first and second high level voltage signals, and a low level voltage signal, and selectively outputting one of the first and second high level voltage signals and the low level voltage signal based on the control signals to generate the first or second scan signal.

8. The apparatus as claimed in claim 1, wherein the driving unit includes:

a switch for receiving a high level voltage signal, and first and second low level voltage signal, and selectively outputting one of the first and second low level voltage signals and the high level voltage signal based on the control signals to generate the first or second scan signal.

9. The apparatus as claimed in claim 1, wherein the driving unit includes:

an integrated circuit (IC) chip for receiving first and second high level voltage signals, and first and second low level voltage signals, and selecting one of the first and second high level voltage signals and one of the first and second low level voltage signals based on the control signals to generate the first or second scan signal.

10. The apparatus as claimed in claim 9, further comprising:

a first high voltage source for generating the first high level voltage signal; and a second high voltage source for generating the second high level voltage signal.

11. The apparatus as claimed in claim 9, further comprising:

a first low voltage source for generating the first low level voltage signal; and a second low voltage source for generating the second low level voltage signal.

12. The apparatus as claimed in claim 1, wherein the driving unit includes:

an integrated circuit chip for receiving first and second low level voltage signals, and a high level voltage signal, and selectively outputting one of the first and second low level voltage signals and the high level voltage signal based on the control signals to generate the first or second scan signal.

13. The apparatus as claimed in claim 1, wherein the driving unit includes:

an integrated circuit chip for receiving first and second high level voltage signals, and a low level voltage signal, and selectively outputting one of the first and second high level voltage signals and the low level voltage signal based on the control signals to generate the first or second scan signal.

14. The apparatus as claimed in claim 1, wherein another one of the control signals indicates whether odd-numbered or even-numbered scanning lines of the liquid crystal panel are driven.

15. The apparatus as claimed in claim 1, wherein the driving unit generates the first or second scan signal by selecting a signal from a plurality of predetermined voltage signals based on the control signals.

16. The apparatus as claimed in claim 15, wherein the driving unit selects the signal from the predetermined voltage signals depending on whether a scanning line is an even number scanning line or an odd-number scanning line.

17. In a liquid crystal display device including a liquid crystal panel having thin film transistors (TFTs) and a plurality of scanning lines connected to the TFTs, a method for driving the plurality of scanning lines, comprising:

selectively generating a first scan signal based on control signals, one of the control signals being generated when at least one of the TFTs is misaligned;

applying the generated first scan signal to the liquid crystal panel to drive the plurality of scanning lines; and applying a second scan signal having the same voltage variation ratio as the first scan signal, so as to reduce flickers in images to be displayed.

18. The method as claimed in claim 17, wherein the selectively generating step includes:

receiving first and second high level voltage signals, and first and second low level voltage signals, and selectively outputting one of the first and second high level voltage signals and one of the first and second low level voltage signals based on the control signals to generate the first or second scan signal.

19. The method as claimed in claim 18, wherein in said receiving step, a voltage level of the second high level voltage signal is greater than that of the first high level voltage signal.

20. The method as claimed in claim 18, wherein in said receiving step, a voltage level of the first low level voltage signal is greater than that of the second low level voltage signal.

21. The method as claimed in claim 1, wherein the selectively generating step includes:

receiving first and second high level voltage signals, and a low level voltage signal, and selectively outputting one of the first and second high level voltage signals and the low level voltage signal based on the control signals to generate the first or second scan signal.

22. The method as claimed in claim 17, wherein the selectively generating step includes:

receiving a high level voltage signal, and first and second low level voltage signal, and selectively outputting one of the first and second low level voltage signals and the high level voltage signal based on the control signals to generate the first or second scan signal.

23. The method as claimed in claim 17, wherein in the selectively generating step, another one of the control signals indicates whether odd-numbered or even-numbered scanning lines of the liquid crystal panel are driven.

24. The method as claimed in claim 17, wherein the generating step generates the first or second scan signal by selecting a signal from a plurality of predetermined voltage signals based on the control signals.

25. The method as claimed in claim 24, wherein the generating step selects the signal from the predetermined voltage signals depending on whether a scanning line is an even number scanning line or an odd-number scanning line.

26. In a liquid crystal display device including a liquid crystal panel having thin film transistors (TFTs) and a plurality of scanning lines connected to the TFTs, an apparatus for driving the plurality of scanning lines, comprising:

a driving unit for selectively generating a first scan signal or a second scan signal based on control signals to drive the plurality of scanning lines so as to reduce flickers in images to be displayed, one of the control signals being generated when at least one of the TFTs is misaligned, wherein the driving unit includes:

a switch for receiving first and second high level voltage signals, and first and second low level voltage signals, and selectively outputting one of the first and second high level voltage signals and one of the first and second low level voltage signals based on the control signals.

27. In a liquid crystal display device including a liquid crystal panel having thin film transistors (TFTs) and a plurality of scanning lines connected to the TFTs, an apparatus for driving the plurality of scanning lines, comprising:

a driving unit for selectively generating a first scan signal or a second scan signal based on control signals to drive the plurality of scanning lines so as to reduce flickers in images to be displayed, one of the control signals being generated when at least one of the TFTs is misaligned, wherein the driving unit includes:

an integrated circuit (IC) chip for receiving first and second high level voltage signals, and first and second low level voltage signals, and selecting one of the first and second high level voltage signals and one of the first and second low level voltage signals based on the control signals to generate the first or second scan signal.

28. In a liquid crystal display device including a liquid crystal panel having thin film transistors (TFTs) and a plurality of scanning lines connected to the TFTs, an apparatus for driving the plurality of scanning lines, comprising:

a driving unit for selectively generating a first scan signal or a second scan signal based on control signals to drive the plurality of scanning lines so as to reduce flickers in images to be displayed, one of the control signals being generated when at least one of the TFTs is misaligned, wherein the driving unit includes:

an integrated circuit chip for receiving first and second low level voltage signals, and a high level voltage signal, and selectively outputting one of the first and second low level voltage signals and the high level voltage signal based on the control signals to generate the first or second scan signal.

29. In a liquid crystal display device including a liquid crystal panel having thin film transistors (TFTs) and a plurality of scanning lines connected to the TFTs, an apparatus for driving the plurality of scanning lines, comprising:

a driving unit for selectively generating a first scan signal or a second scan signal based on control signals to drive the plurality of scanning lines so as to reduce flickers in images to be displayed, one of the control signals being generated when at least one of the TFTs is misaligned, wherein the driving unit includes:

an integrated circuit chip for receiving first and second high level voltage signals, and a low level voltage signal, and selectively outputting one of the first and second high level voltage signals and the low level voltage signal based on the control signals to generate the first or second scan signal.

30. In a liquid crystal display device including a liquid crystal panel having thin film transistors (TFTs) and a plurality of scanning lines connected to the TFTs, a method for driving the plurality of scanning lines, comprising:

selectively generating a first scan signal or a second scan signal based on control signals, one of the control signals being generated when at least one of the TFTs is misaligned; and applying the generated first or second scan signal to the liquid crystal panel to drive the plurality of scanning lines so as to reduce flickers in images to be displayed, wherein the selectively generating step includes:

receiving first and second high level voltage signals, and first and second low level voltage signals, and selectively outputting one of the first and second high level voltage signals and one of the first and second low level voltage signals based on the control signals to generate the first or second scan signal.

31. In a liquid crystal display device including a liquid crystal panel having thin film transistors (TFTs) and a plurality of scanning lines connected to the TFTs, a method for driving the plurality of scanning lines, comprising:

selectively generating a first scan signal or a second scan signal based on control signals, one of the control signals being generated when at least one of the TFTs is misaligned; and applying the generated first or second scan signal to the liquid crystal panel to drive the plurality of scanning lines so as to reduce flickers in images to be displayed, wherein the selectively generating step includes:

receiving first and second high level voltage signals, and a low level voltage signal, and selectively outputting one of the first and second high level voltage signals and the low level voltage signal based on the control signals to generate the first or second scan signal.

32. In a liquid crystal display device including a liquid crystal panel having thin film transistors (TFTs) and a plurality of scanning lines connected to the TFTs, a method for driving the plurality of scanning lines, comprising:

selectively generating a first scan signal or a second scan signal based on control signals, one of the control signals being generated when at least one of the TFTs is misaligned; and applying the generated first or second scan signal to the liquid crystal panel to drive the plurality of scanning lines so as to reduce flickers in images to be displayed, wherein the selectively generating step includes:

receiving a high level voltage signal, and first and second low level voltage signal, and selectively outputting one of the first and second low level voltage signals and the high level voltage signal based on the control signals to generate the first or second scan signal.

33. In a liquid crystal display device including a liquid crystal panel having thin film transistors (TFTs) and a plurality of scanning lines connected to the TFTs, an apparatus for driving the plurality of scanning lines, comprising:

a driving unit for selectively generating a first scan signal or a second scan signal based on control signals to drive the plurality of scanning lines so as to reduce flickers in images to be displayed, one of the control signals being generated when at least one of the TFTs is misaligned, wherein the driving unit generates the first or second scan signal by selecting a signal from a plurality of predetermined voltage signals based on the control signals, and wherein the driving unit selects the signal from the predetermined voltage signals depending on whether a scanning line is an even number scanning line or an odd-number scanning line.

34. In a liquid crystal display device including a liquid crystal panel having thin film transistors (TFTs) and a plurality of scanning lines connected to the TFTs, a method for driving the plurality of scanning lines, comprising:

selectively generating a first scan signal or a second scan signal based on control signals, one of the control signals being generated when at least one of the TFTs is misaligned; and applying the generated first or second scan signal to the liquid crystal panel to drive the plurality of scanning lines so as to reduce flickers in images to be displayed, wherein the generating step generates the first or second scan signal by selecting a signal from a plurality of predetermined voltage signals based on the control signals, and wherein the generating step selects the signal from the predetermined voltage signals depending on whether a scanning line is an even number scanning line or an odd-number scanning line.

* * * * *

UNITED STATES PATENT AND TRADEMARK OFFICE

CERTIFICATE OF CORRECTION

PATENT NO. : 6,590,551 B1
DATED : July 8, 2003
INVENTOR(S) : Jeom Jae Kim

It is certified that error appears in the above-identified patent and that said Letters Patent is hereby corrected as shown below:

Title page,
Item [73], Assignee, should read: -- LG. Philips LCD Co., Ltd. --

Signed and Sealed this

Eighteenth Day of May, 2004

JON W. DUDAS
*Acting Director of the United States Patent and Trademark Office*